US005142189A

United States Patent [19]

Sugahara et al.

[11] Patent Number: 5,142,189

[45] Date of Patent: Aug. 25, 1992

[54] IN-LINE TYPE ELECTRON GUN FOR A COLOR CATHODE RAY TUBE

[75] Inventors: Koichi Sugahara, Sakai; Osamu Konosu; Hiroshi Suzuki, both of Nagaokakyo; Noboru Tominaga, Takatsuki, all of Japan

[73] Assignee: Matsushita Electronics Corporation, Osaka, Japan

[21] Appl. No.: 609,977

[22] Filed: Nov. 6, 1990

[30] Foreign Application Priority Data

Nov. 8, 1989 [JP] Japan ..... 1-290215

[51] Int. Cl.[5] ..... H01J 29/62

[52] U.S. Cl. ..... 313/414

[58] Field of Search ..... 313/414, 412

[56] References Cited

U.S. PATENT DOCUMENTS 4,542,318 9/1985 Say ..... 313/414

4,622,491 11/1986 Izumida et al. ..... 313/414

FOREIGN PATENT DOCUMENTS 58-18842 2/1983 Japan .

8103752 6/1983 Japan .

9215640 12/1984 Japan .

63-86224 4/1988 Japan .

*Primary Examiner*—Sandra L. O'Shea

*Attorney, Agent, or Firm*—Panitch Schwarze Jacobs & Nadel

[57] ABSTRACT

An in-line type electron gun used in a color cathode ray tube apparatus, the electron gun comprising a focusing grid, a final accelerating grid adjacent to the focusing grid, these grids having elongated cylindrical apertures having their majors extending horizontally, a field correction metal plate located in each grid along the elongated aperture, the field correction metal plate having three apertures produced in an in-line arrangement, wherein the central aperture is elongated with a major extending vertically, and the two apertures on each side are circular, the horizontal diameter $L_s$ and the vertical diameter $\phi_v$ having a ratio $\phi_v/L_s$ of 0.49 to 0.6.

2 Claims, 2 Drawing Sheets

IN-LINE TYPE ELECTRON GUN FOR A COLOR CATHODE RAY TUBE

BACKGROUND OF THE INVENTION

1. Field of the Invention

The present invention relates generally to an in-line type electron gun used in a color cathode ray tube apparatus, and more particularly to a grid of the electron gun situated in and near the main lens field thereof.

2. Description of the Prior Art

There are many proposals to minimize the influence of spherical aberration against three electron beams. For example, Japanese Laid-Open Publications Nos. 58-103752, 59-215640, and 63-86224 disclose how the effective diameter of a lens situated in and around a main lens field is increased.

In these known systems a focusing grid and a final accelerating grid adjacent thereto are respectively provided with elongated apertures in their opposing end faces, each elongated aperture having a major axis (hereinafter referred to as "major") extending horizontally, and each grid is provided with a field correction metal plate placed along the respective elongated aperture. In addition, three non-circular elongated apertures having majors extending vertically are provided in an in-line arrangement.

These known systems are advantageous in that they can produce a main lens field having a large diameter, but a major disadvantage is that the accurate assembling of an electron gun is difficult to center the components because of the non-circular shape of the apertures produced in the field correction metal plate.

Japanese Laid-Open Patent Publication No. 58-18842 discloses a system in which a focusing grid and a final accelerating grid adjacent thereto are respectively provided with elongated depressions in their opposing end faces, each elongated depression having three circular apertures produced in an in-line arrangement. Under this system, to achieve a desired lens field, the planar side of either depression must be shaped like dumb-bell, thereby making it impossible to use the same shape of components for the two grids. This increases the production cost.

SUMMARY OF THE INVENTION

The in-line type electron gun of the present invention, which overcomes the above-discussed and numerous other disadvantages and deficiencies of the prior art, comprises a focusing grid, a final accelerating grid adjacent to the focusing grid, these grids having elongated cylindrical apertures having their majors extending horizontally, a field correction metal plate located in each grid along the elongated aperture, the field correction metal plate having three apertures produced in an in-line arrangement, wherein the central aperture is elongated with a major extending vertically, and the two apertures on each side are circular, the horizontal diameter $L_s$ and the vertical diameter $\phi_v$ having a ratio $\phi_v/L_s$ of 0.49 to 0.6.

In a preferred embodiment, the field correction metal plates are situated inward by a distance of 4.0 mm to 5.5 mm from the end faces of the respective elongated apertures.

Thus, the invention described herein makes possible the objectives of (1) providing an in-line type electron gun which can be assembled with ease and precision, (2) providing an in-line type electron gun having components commonly usable by the focusing grid and the final accelerating grid, thereby reducing the production cost, and (3) providing an in-line electron gun capable of minimizing the influence of a lens field provided by the outer electrodes.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
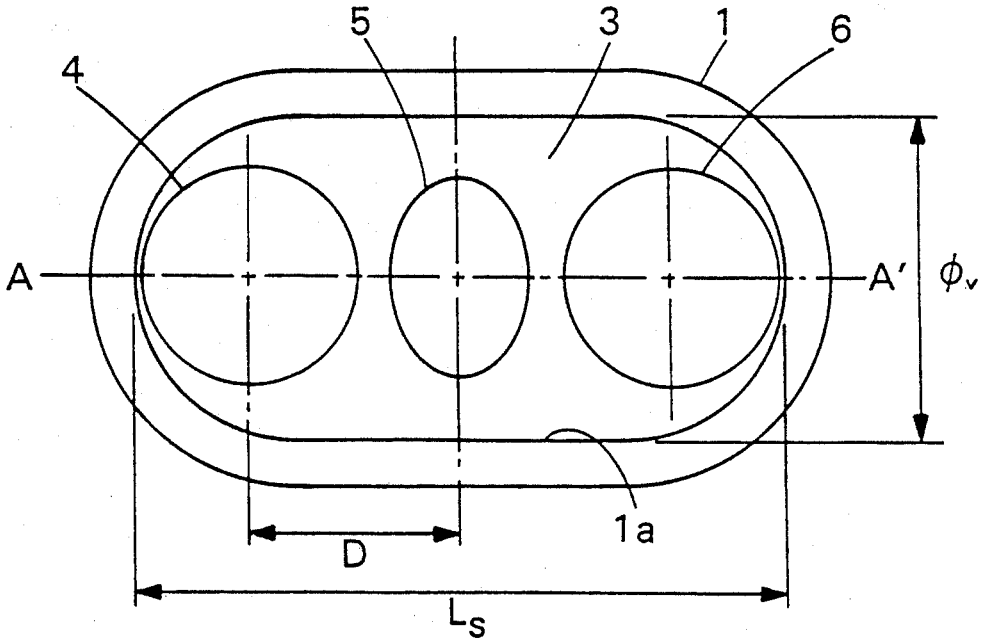
FIG. 1 view showing a main lens field of an in-line electron gun according to the present invention.
Figure 2:
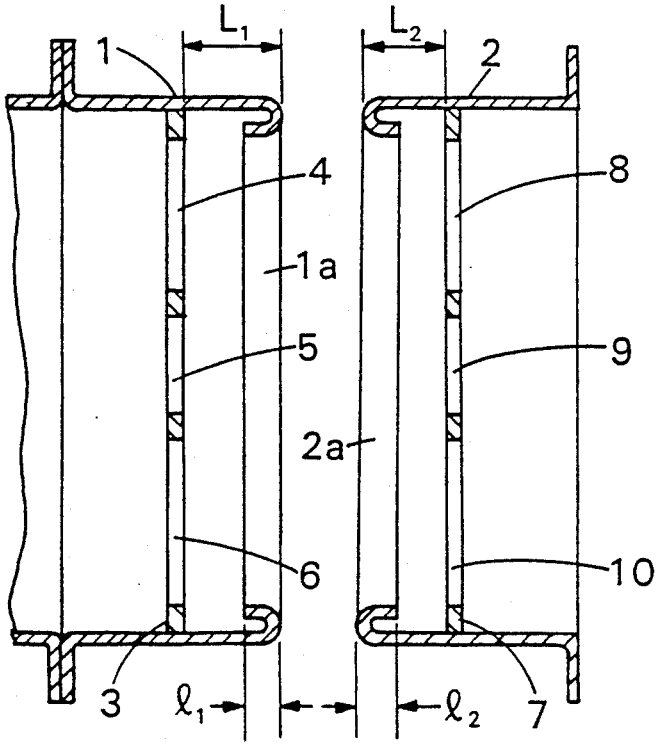
FIG. 2 is a cross-sectional view taken along the line A—A' in FIG. 1.

Referring to FIGS. 1 and 2, an in-line type electron gun includes a focusing grid 1 and a final accelerating grid (anode) 2 adjacent to the focusing grid 1 are provided with elongated apertures 1*a* and 2*a* in their opposing end faces, respectively. Each of the elongated apertures 1*a* and 2*a* has a horizontally extending major. The focusing grid 1 accommodates an elliptical field correction metal plate 3, which is provided with three apertures 4, 5 and 6 aligned in an in-line arrangement. The final accelerating grid (anode) 2 is provided with an elliptical field correction metal plate 7 disposed along the elongated aperture 2*a*. The field correction metal plate 7 is also provided with three apertures 8, 9 and 10 aligned in an in-line arrangement. The central apertures 5 and 9 of the two field correction metal plates 3 and 7 are elliptical with vertically extending majors, whereas the apertures 4, 6, 8 and 10 are circular.

One example of a color cathode ray tube equipped with a bi-potential type electron gun con-structed in this way had a rectangular face panel having a diagonal length of 29 inches to 35 inches, a neck having an outside diameter of 29 mm to 32.5 mm. This color cathode ray tube produced three large main lens fields between the focusing grid 1 and the final accelerating grid 2. In the example, each elongated apertures 1*a* and 2*a* were 21.0 mm in horizontal diameter ($L_s$) and 10.5 mm in vertical diameter ($\phi_v$), and the circular apertures 4, 6, 8 and 10 of the field correction metal plates 3 and 7 were 3.6 mm in diameter, and the elliptical apertures 5 and 9 thereof were 2.4 mm in horizontal diameter and 3.2 mm in vertical diameter. The distance $L_1$ between the elongated aperture 1*a* and the field correction metal plate 3 of the focusing grid 1 was 4.0 mm to 5.5 mm. The distance $L_2$ between the elongated aperture 2*a* and the field correction metal plate 7 of the final accelerating grid 2 was 4.0 mm to 5.5 mm. As shown in FIG. 2, the terminating edges of the focusing grid 1 and the accelerating grid 2 are respectively curled inward. The curled portions of the elongated apertures 1*a* and 2*a* had lengths l1 and l2 of 1 mm.

In the illustrated example, the ratio of the vertical diameter to the horizontal diameter $L_s$ was decided as follows:

$$\phi_v/L_s = 10.5\ \text{mm}/21.0\ \text{mm} = 0.5$$

Figure 3:
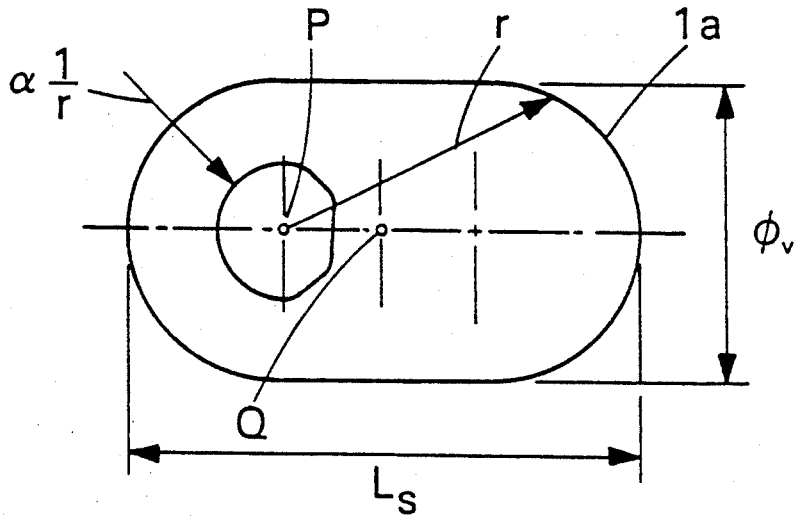
FIGS. 3 and 4(*a*) to (*c*) are diagrammatic views exemplify principles underlying the present invention.
Figure 4A:
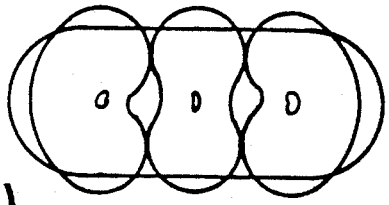
Figure 4B:
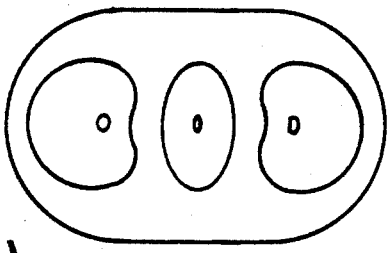
Figure 4C:
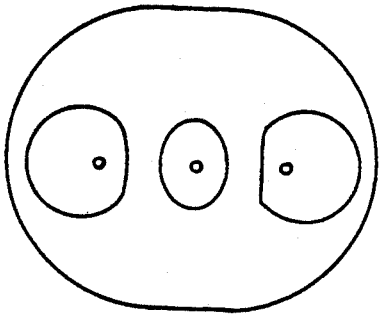

The reason for setting the value to 0.5 will be exemplified by reference to FIGS. 3 and 4:

The letter P indicates the central axes of the circular apertures 4, 6, 8, and 10, and Q indicates the central axis of the elliptical apertures 5 and 9. The distance between the axes P and Q was 5.5 mm. In general, an astigmatic field distortion given by the focusing electrode and the final accelerating electrode (both will hereinafter be called the "outer electrodes") to the central axes P becomes larger in proportion to the distance r. To correct the field distortion, it is required to generate a correction field by the field correction metal plate so as to be applicable proportionally to the reciprocal of r (1/r). Since the apertures 4 to 6, and 8 to 10 of the field correction metal plates 3 and 7 are smaller than the elongated apertures 1*a* and 2*a*, they can generate a stronger lens field than that given by the outer electrodes irrespective of the distance from the elongated apertures 1*a* and 2*a*. In order to generate a non-astigmatic three main lens fields, it is preferable to shape the circular apertures 3 and 5, and 8 and 10 in a more circular form centering around the central axis P than those shown in FIG. 3.

FIGS. 4(*a*), 4(*b*) and 4(*c*) show the preferable shapes of the side apertures 4, 6, 8, and 10, and the central apertures 4 and 10 taken in accordance with when $\phi_v/L_s$ was 0.4, when $\phi_v/L_s$ was 0.6, and when $\phi_v/L_s$ was 0.8, respectively. It will be understood from this that as the value of $\phi_v/L_s$ becomes larger, the shape of each aperture becomes more circular.

If the horizontal diameters $L_s$ of the elongated apertures 1*a* and 2*a* of the outer electrodes, and the effective diameter of the main lens are constantly set to 21.0 mm, and the vertical diameter $\phi_v$ of the elongated apertures 1*a* and 2*a* becomes larger, the diameter of each aperture 4 to 6 and 8 to 10 must become smaller. This is because a reduction in the focusing action of the lens in the vertical direction must be compensated by the field correction metal plates 3 and 7 within the lens field.

The outer electrodes are obtained by drawing a metal sheet of 0.25 mm to 0.4 mm thick in a known manner, and the field correction metal plates 3 and 7 are obtained by punching. The field correction metal plate 1*a* and 2*a* can be made to more constant dimensions than the outer electrodes, thereby ensuring that a largest possible vertical diameters $\phi_v$ of the elongated apertures 1*a* and 2*a* enables the main lens field to have a larger diameter with the minimum of astigmatism.

The outer electrodes must be fixedly supported by a pair of glass rods provided at their opposite sides, and the value of $\phi_v/L_s$ has an upper limit derived from the fact that as the diameter of the glass neck enveloping the glass rods and the electrode assembly become large, they are likely to cause a lower deflection efficiency.

Taking into consideration the above-mentioned factors, the present invention have achieved the structure in which the side apertures 4, 6, 8 and 10 of the field correction metal plate 3 and 7 are circular, and the ratio of the vertical diameter to the horizontal diameter of the elongated apertures of the outer electrodes, that is, $\phi_v/L_s$ is set to 0.49 to 0.6.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An in-line type electron gun used in a color cathode ray tube apparatus, the in-line type electron gun comprising a focusing grid, a final accelerating grid adjacent to the focusing grid, the focusing grid and the accelerating grid each having an elongated cylindrical aperture, each elongated aperture having a major axis extending horizontally, a first field correction metal plate located in said focusing grid along the elongated aperture, a second field correction metal plate located in said accelerating grid along the elongated aperture, said first and second field correction metal plates each having three apertures produced in an in-line arrangement, wherein a central aperture of each set of three apertures is elongated with a major axis extending vertically to the horizontal elongated cylindrical aperture, and the two outer apertures on each side of the central aperture being circular, each horizontal diameter $L_s$ of the elongated apertures of the focusing grid and the accelerating grid and each vertical diameter $\phi_v$ thereof having a ratio of $\phi_v/L_s$ of 0.49 to 0.6.

2. An in-line type electron gun according to claim 1, wherein the field correction metal plates are situated inward by a distance of 4.0 mm to 5.5 mm from the end faces of the respective elongated apertures.

* * * * *

UNITED STATES PATENT AND TRADEMARK OFFICE

CERTIFICATE OF CORRECTION

PATENT NO. : 5,142,189

DATED : August 25, 1992

INVENTOR(S) : Koichi Sugahara et al.

It is certified that error appears in the above-identified patent and that said Letters Patent is hereby corrected as shown below:

In the Drawings:

Figure 3, delete "$\alpha$" and insert --$\alpha$--.
As shown below:

Fig. 3

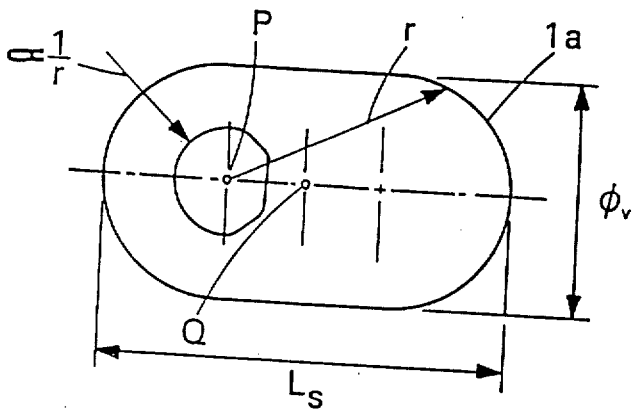

Signed and Sealed this

Twenty-eighth Day of September, 1993

*Attest:*

*Attesting Officer*

BRUCE LEHMAN

*Commissioner of Patents and Trademarks*